US011407478B2

(12) United States Patent
Corot et al.

(10) Patent No.: US 11,407,478 B2
(45) Date of Patent: Aug. 9, 2022

(54) SYSTEM FOR STORING AND TRANSPORTING A CRYOGENIC FLUID ON A SHIP

(71) Applicant: GAZTRANSPORT ET TECHNIGAZ, Saint Remy les Chevreuse (FR)

(72) Inventors: Sébastien Corot, Saint Remy les Chevreuse (FR); Sébastien Delanoe, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 97 days.

(21) Appl. No.: 16/970,998

(22) PCT Filed: Feb. 12, 2019

(86) PCT No.: PCT/FR2019/050301

§ 371 (c)(1),
(2) Date: Aug. 19, 2020

(87) PCT Pub. No.: WO2019/162594

PCT Pub. Date: Aug. 29, 2019

(65) Prior Publication Data

US 2020/0398943 A1 Dec. 24, 2020

(30) Foreign Application Priority Data

Feb. 20, 2018 (FR) ..... 1851447

(51) Int. Cl.

| | |
|---|---|
| ***B63B 27/24*** | (2006.01) |
| ***F17C 3/02*** | (2006.01) |
| ***F17C 13/08*** | (2006.01) |

(52) U.S. Cl.

CPC ..... *B63B 27/24* (2013.01); *F17C 3/027* (2013.01); *F17C 13/082* (2013.01); (Continued)

(58) Field of Classification Search

CPC . B63B 27/00; B63B 27/24; F17C 3/00; F17C 3/027; F17C 13/00; F17C 13/082; (Continued)

(56) References Cited

U.S. PATENT DOCUMENTS

| | | | | |
|---|---|---|---|---|
| 3,648,880 | A | 3/1972 | Jackson | |
| 9,915,397 | B2 * | 3/2018 | Jean | B63B 25/16 |

FOREIGN PATENT DOCUMENTS

| | | |
|---|---|---|
| CN | 105570665 | 5/2016 |
| FR | 2991430 | 12/2013 |

(Continued)

OTHER PUBLICATIONS

International Search Report for PCT/FR2019/050301 dated Sep. 17, 2019, 9 pages.

*Primary Examiner* — Lars A Olson
(74) *Attorney, Agent, or Firm* — Nixon & Vanderhye

(57) ABSTRACT

An installation for storing and transporting a cryogenic fluid on a ship includes: a sealed and thermally insulating tank, having a ceiling wall including, from the outside to the inside, a primary thermally insulating barrier and a primary sealing membrane intended to be in contact with the cryogenic fluid; and a sealed line penetrating through the ceiling wall of the tank, the line including a bottom portion of which a first end is situated inside the ceiling wall of the tank and a second end is situated outside the ceiling wall of the tank in a thicknesswise direction of the ceiling wall, and a top portion fixed to the second end of the bottom portion. The bottom portion includes an alloy with low thermal expansion coefficient. The primary sealing membrane is tightly fixed to the bottom portion of the line around the line.

20 Claims, 4 Drawing Sheets

(52) U.S. Cl.
CPC ..... *F17C 2203/0643* (2013.01); *F17C 2221/033* (2013.01); *F17C 2223/0161* (2013.01); *F17C 2223/033* (2013.01); *F17C 2227/0135* (2013.01); *F17C 2270/0107* (2013.01)

(58) Field of Classification Search
CPC ..... F17C 2203/0643; F17C 2223/0161; F17C 2227/0135; F17C 2270/0107
USPC ..... 114/74 A
See application file for complete search history.

(56) References Cited

FOREIGN PATENT DOCUMENTS

| | | |
|---|---|---|
| KR | 10-2011-0026945 | 3/2011 |
| WO | 2016/120540 | 8/2016 |
| WO | 2017/216477 | 12/2017 |

* cited by examiner

SYSTEM FOR STORING AND TRANSPORTING A CRYOGENIC FLUID ON A SHIP

This application is the U.S. national phase of International Application No. PCT/FR2019/050301 filed Feb. 12, 2019 which designated the U.S. and claims priority to French Patent Application No. 1851447 filed Feb. 20, 2018, the entire contents of each of which are hereby incorporated by reference.

TECHNICAL FIELD

The invention relates to the field of installations for storing and transporting a cryogenic fluid on ships and comprising one or more sealed and thermally insulating membrane tanks.

The tank or tanks can be intended to transport cryogenic fluid or receive cryogenic fluid used as fuel to propel the ship.

TECHNOLOGICAL BACKGROUND

Liquefied natural gas transport ships have a plurality of tanks for storing the cargo. The liquefied natural gas is stored in these tanks, at atmospheric pressure, at approximately −162° C. and is thus in a state of diphasic liquid-vapor equilibrium such that the heat flux exerted through the walls of the tanks tends to cause an evaporation of the liquefied natural gas.

In order to avoid generating overpressures inside the tanks, each tank is associated with a sealed exhaust line for the vapor produced by the evaporation of the liquefied natural gas. Such a sealed vapor exhaust line is notably described in the application WO2013093261, for example. The line passes through a wall of the tank and emerges in the top part of the internal space of the tank and thus defines a vapor passage between the internal space of the tank and a vapor collector arranged outside the tank. The vapor thus collected can then be transmitted to a reliquefaction installation in order to then reintroduce the fluid into the tank, to an energy production plant or to an exhaust riser provided on the deck of the ship.

In some grounding conditions, when the level of filling of the tank is maximum and the ship is grounded in a position in which it has a significant list inclination and/or trim inclination, there is a risk of the vapor exhaust line emerging in the liquid phase and therefore no longer being in contact with the vapor phase stored in the tank. In such circumstances, isolated pockets of gas in vapor phase are likely to form inside the tanks. Such gas pockets are likely to create overpressures which can damage the tanks and/or result in an expulsion of the liquid phase out of the tank through the abovementioned vapor exhaust line.

However, the sealed gas exhaust lines of the prior art have large dimensions, are fairly complex and are not suited to significant temperature variations.

SUMMARY

One idea on which the invention is based is to propose a solution for having a sealed line penetrate through the wall of a membrane tank which is relatively simple and which withstands the temperature variations between the ambient temperature and the cryogenic fluid storage temperature.

Another idea on which the invention is based is to propose a solution which withstands deformations of the ship in transportation at sea, notably bending of the hull girder.

Another idea on which the invention is based is to propose a solution which adapts easily to already existing storage tank structures.

Another idea on which the invention is based is to propose an installation for storing and transporting a cryogenic fluid on a ship which makes it possible to reduce the risks of such isolated pockets of gas in vapor phase forming inside a tank without being able to be evacuated therefrom.

According to one embodiment, the invention provides an installation for storing and transporting a cryogenic fluid on a ship, the installation comprising:

- a sealed and thermally insulating tank intended for the storage of the cryogenic fluid in a state of diphasic liquid-vapor equilibrium, the tank having a ceiling wall comprising, in the thicknesswise direction of the wall from the outside to the inside of the tank, a primary thermally insulating barrier and a primary sealing membrane intended to be in contact with the cryogenic fluid;
- a sealed line penetrating through the ceiling wall of the tank so as to define an exhaust passage for the liquid phase of the cryogenic fluid from the inside to the outside of the tank, the line comprising a bottom portion of which a first end is situated inside the ceiling wall of the tank and a second end is situated outside the ceiling wall of the tank in a thicknesswise direction of the ceiling wall, and a top portion fixed to the second end of the bottom portion;

wherein the bottom portion is composed of an alloy with low thermal expansion coefficient, and wherein the primary sealing membrane is tightly fixed to the bottom portion of the line around the line.

By virtue of these features, the sealed line penetrating through the wall makes it possible to reduce the risks of such isolated pockets of gas in vapor phase forming inside a tank by defining an exhaust passage. Furthermore, the bottom portion of the line which is in contact with the cryogenic fluid is made of a material with low thermal expansion coefficient which makes it possible to ensure that the line withstands the temperature variations between the ambient temperature and the cryogenic fluid storage temperature by preventing it from being deformed.

According to other advantageous embodiments, such an installation can have one or more of the following features.

According to one embodiment, the line passes through the ceiling wall at an end of the ceiling wall.

According to one embodiment, the line is a first line and the storage installation comprises a second line similar to the first line, the second line passing through the ceiling wall at an end opposite the end where the first line passes through.

According to one embodiment, the storage installation comprises a gas dome situated at the center of the ceiling wall.

According to one embodiment, the first end of the bottom portion of the line is a collection end emerging inside the tank to collect a vapor phase of the liquefied gas. Such a line for collecting the vapor phase in the tank can be provided with a relatively small diameter, for example less than 100 mm.

According to one embodiment, the second end of the top portion of the sealed line is linked to a gas dome of the tank and/or to a main gas collector and/or to pressure relief valves of the tank.

According to one embodiment, the bottom portion of the line and the primary sealing membrane are composed of an iron-nickel alloy with a thermal expansion coefficient of between 1.2 and $2.0\times10^{-6}$ $K^{-1}$, or of an iron alloy with high manganese content with an expansion coefficient typically of the order of $7.10^{-6}$ $K^{-1}$.

According to one embodiment, the bottom portion is composed of an iron-nickel alloy with 36% Ni by weight.

According to one embodiment, the top portion is composed of stainless steel.

According to one embodiment, the top portion has a greater thickness than the bottom portion.

According to one embodiment, the bottom portion is tightly welded to the primary sealing membrane via a flange ring.

Thus, a tight link is ensured between the bottom portion of the line and the primary sealing membrane by the flange ring.

According to one embodiment, the ceiling wall of the tank also comprises, in the thicknesswise direction of the wall outside the primary thermally insulating barrier, a secondary thermally insulating barrier and a secondary sealing membrane.

By virtue of these features, the thermal insulation and the seal-tightness of the storage tank is ensured by two layers of sealing membranes, primary and secondary, and two layers of thermally insulating barriers, primary and secondary, which makes it possible According to one embodiment, the primary and secondary membranes are composed of an iron-nickel alloy with 36% Ni by weight with a thermal expansion coefficient of between 1.2 and $2.0\times10^{-6}$ $K^{-1}$ or an iron alloy with high manganese content with an expansion coefficient that is typically of the order of $7.10^{-6}$ $K^{-1}$.

According to one embodiment, the primary thermally insulating barrier and the secondary thermally insulating barrier are each composed of a plurality of insulating caissons, the line passing right through one of the caissons of the plurality of caissons of each of the primary and secondary thermally insulating barriers.

According to one embodiment, the line passes through a caisson in a central zone of the caisson.

According to one embodiment, a caisson of the plurality of caissons is composed of plywood sheets forming a grid network, the caisson being filled inside the grid network with expanded perlite or glass wool or other insulating material.

According to one embodiment, the primary sealing membrane and/or the secondary sealing membrane comprise a plurality of elongate strakes with raised edges welded edge-to-edge in the longitudinal direction of the strake, each strake comprising a flat zone between two longitudinal raised edges, the line passing through the primary sealing membrane and/or the secondary sealing membrane through the flat zone of an elongate strake.

According to one embodiment, the strake of the primary sealing membrane and/or of the secondary sealing membrane passed through by the line comprises a reinforced portion, the reinforced portion having a greater thickness than the rest of the strake and comprising a flat zone between two longitudinal raised edges, the line passing through the reinforced portion.

Thus, the reinforced portion makes it possible to rigidify and reinforce the join between the primary or secondary sealing membrane and the sealed line or the sheath respectively.

For example, in the case where a strake has a thickness less than 1 mm, for example 0.7 mm, the reinforced portion has a thickness greater than or equal to 1 mm, for example 1.5 mm.

According to one embodiment, the sealed line passes through the reinforced portion of the primary sealing membrane and/or of the secondary sealing membrane through the flat zone of the reinforced portion.

By virtue of these features, the line passes through the reinforced portion in a zone where it is simpler to use a tight link between the line and the strake. Furthermore, that also avoids having to interrupt the raised edges of the strakes with the sealed line.

According to one embodiment, the installation comprises a sheath surrounding the line with a gap in a radial direction and fixed to the top portion of the line, the sheath extending from the top portion at least to the secondary sealing membrane, and the secondary sealing membrane being tightly fixed to the sheath all around the sheath.

Thus, the fixing of the secondary sealing membrane is done on a sheath surrounding the line, the sheath being itself fixed to the top portion which makes it possible to have a double wall all along the bottom portion of the line, thus avoiding, in the event of a break of the line, cryogenic fluid from spilling out of the storage tank. The sheath therefore serves as continuity of the secondary sealing membrane. Furthermore, the fixing of the sheath onto the top portion of the line makes it possible to simplify maintenance operations. Finally, the radial gap between the sheath and the line makes it possible to take into account the greater deformation of the sheath due to its flexibility which is also greater relative to the line.

According to one embodiment, the sheath extends from the top portion at least to the secondary sealing membrane and beyond.

According to one embodiment, the secondary sealing membrane is tightly welded to the sheath all around the sheath.

According to one embodiment, a filling of insulating material is arranged between the sheath and the sealed line.

According to one embodiment, the sheath is welded to the secondary sealing membrane via a flange ring.

Thus, a tight link is ensured between the bottom portion of the line and the secondary sealing membrane by the flange ring.

According to one embodiment, the flange ring or rings have a thickness greater than the strakes. For example, in the case where the strake is less than 1 mm thick, for example 0.7 mm, the flange ring has a thickness of between 1 and 2 mm, preferably 1.5 mm.

Thus, the flange ring makes it possible to rigidify and reinforce the junction between the primary or secondary sealing membrane and the line or the sheath respectively.

According to one embodiment, the flange ring is composed of a base, preferably of annular and flat form, and a flange protruding from the base. The base can have a thickness greater than the strakes, preferably a thickness of between 1 and 2 mm, preferentially 1.5 mm. The flange can have a thickness greater than the strakes, preferably a thickness of between 1 and 2 mm, preferentially 1.5 mm.

According to one embodiment, the sheath is composed of an iron-nickel alloy with 36% Ni by weight with a thermal expansion coefficient of between 1.2 and $2.0\times10^{-6}$ $K^{-1}$, or of an iron alloy with high manganese content with an expansion coefficient typically of the order of $7.10^{-6}$ $K^{-1}$.

According to one embodiment, the invention provides a ship comprising an installation according to the invention, the ceiling wall being attached to a bottom surface of an intermediate deck of the ship.

According to one embodiment, the line comprises a bellows compensator on an end of the top portion remote from the bottom portion, the compensator being configured to ensure the fixing of the line to a top surface of a top deck of the ship, the compensator having corrugations configured to allow the thermal contraction of the line.

By virtue of these features, the bellows compensator allows the line, notably the top portion, to have, at its fixing, a link play allowing it to contract/expand thermally without risk of breaking of the line or of the link.

According to one embodiment, the bellows compensator is composed of stainless steel.

According to one embodiment, the line comprises an insulating sleeve surrounding a part of the top portion of the line and situated between the intermediate deck of the ship and a top deck of a ship.

Thus, the insulating sleeve makes it possible to thermally insulate a part of the top portion so that the low temperatures of the cryogenic fluid are not propagated into the between-deck with the risk of damaging the equipment situated at this point.

According to one embodiment, the intermediate deck and the top deck comprise an orifice, the orifice having a diameter greater than an outer diameter of the top portion of the line, the line passing through the intermediate and the top deck through the intermediate deck orifice and the top deck orifice respectively.

By virtue of these features, there is a gap between the line and the orifice of the top deck and the orifice of the intermediate deck, which makes it possible to obtain a mounting play between the line and the two decks. The mounting play notably makes it possible to simplify the mounting and accept deformations of the decks without damaging the line.

According to one embodiment, the intermediate deck comprises a coaming on a top surface of the intermediate deck, the coaming surrounding the intermediate deck orifice and being passed through by the line, and in which the line is fixed to the coaming.

Thus, the coaming makes it possible to offset the fixing of the line to the intermediate deck which provides fixing flexibility. This offset of fixing allows the line to better support the deformations of the intermediate deck by avoiding damage to the line.

According to one embodiment, the line is tightly welded all around the coaming.

According to one embodiment, the coaming comprises a top part and a lateral part linking the top part to the intermediate deck, the fixing of the line being done in the top part of the coaming.

According to one embodiment, the coaming is composed of a metal, notably of stainless steel.

According to one embodiment, the invention provides a method for loading or offloading a ship according to the invention, wherein a cryogenic fluid is conveyed through insulated pipelines from or to a floating or onshore storage installation to or from a tank of the ship.

According to one embodiment, the invention provides a transfer system for a cryogenic fluid, the system comprising a ship according to the invention, insulated pipelines arranged so as to link the tank installed in the double hull of the ship to a floating or onshore storage installation and a pump for driving a flow of cryogenic fluid through the insulated pipelines from or to the floating or onshore storage installation to or from the tank of the ship.

BRIEF DESCRIPTION OF THE FIGURES

The invention will be better understood, and other aims, details, features and advantages thereof will emerge more clearly from the following description of several particular embodiments of the invention, given purely in an illustrative and nonlimiting manner, with reference to the attached drawings.

DETAILED DESCRIPTION OF EMBODIMENTS

By convention, the terms "top", "bottom", "above" and "below" are used to define a relative position of an element or of a part of an element with respect to another in a direction directed from the tank 2 to the top deck 9 of the ship 1.

Figure 1:
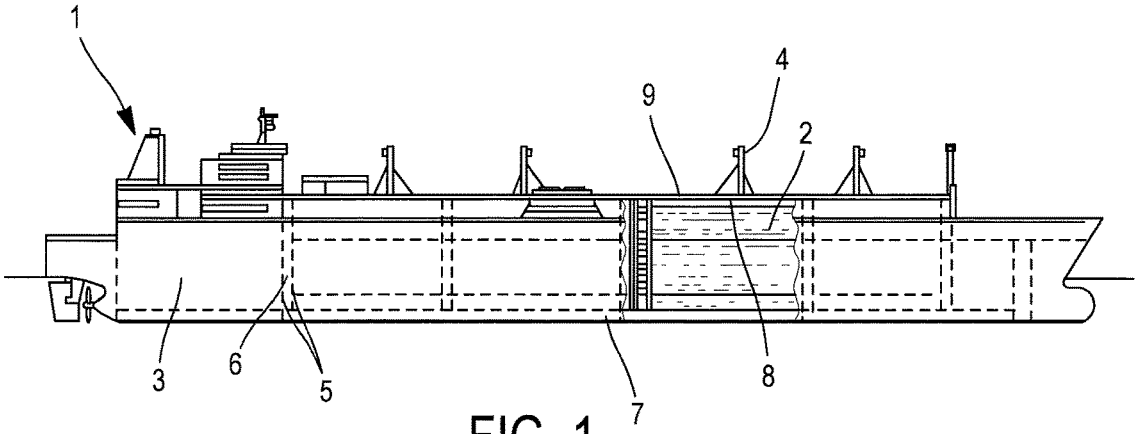
FIG. 1 is a cutaway schematic representation of a ship comprising a cryogenic fluid storage tank.

FIG. 1 shows a ship 1 equipped with an installation for storing and transporting cryogenic fluid, notably liquefied natural gas, which comprises a plurality of sealed and thermally insulating tanks 2. Each tank 2 is associated with an exhaust riser 4 provided on a top deck 9 of the ship 1 and allows gas in vapor phase to escape from the occurrence of an overpressure inside the associated tank 2.

At the aft end of the ship 1 there is a machine compartment 3 which conventionally comprises a hybrid supply steam turbine capable of operating either by diesel fuel combustion, or by combustion of oil-off gas coming from the tanks 2.

The tanks 2 have a longitudinal dimension extending along the longitudinal direction of the ship 1. Each tank 2 is bordered at each of its longitudinal ends by a pair of transverse partitions 5 delimiting a sealed separating space, known as "cofferdam" 6.

The tanks are thus separated from one another by a transverse cofferdam 6. It can thus be seen that the tanks 2 are each formed inside a supporting structure which consists, on the one hand, of the double hull 7 of the ship 11, and on the other hand, of one of the transverse partitions 5 of each of the cofferdams 6 bordering the tank 2.

Figure 2:
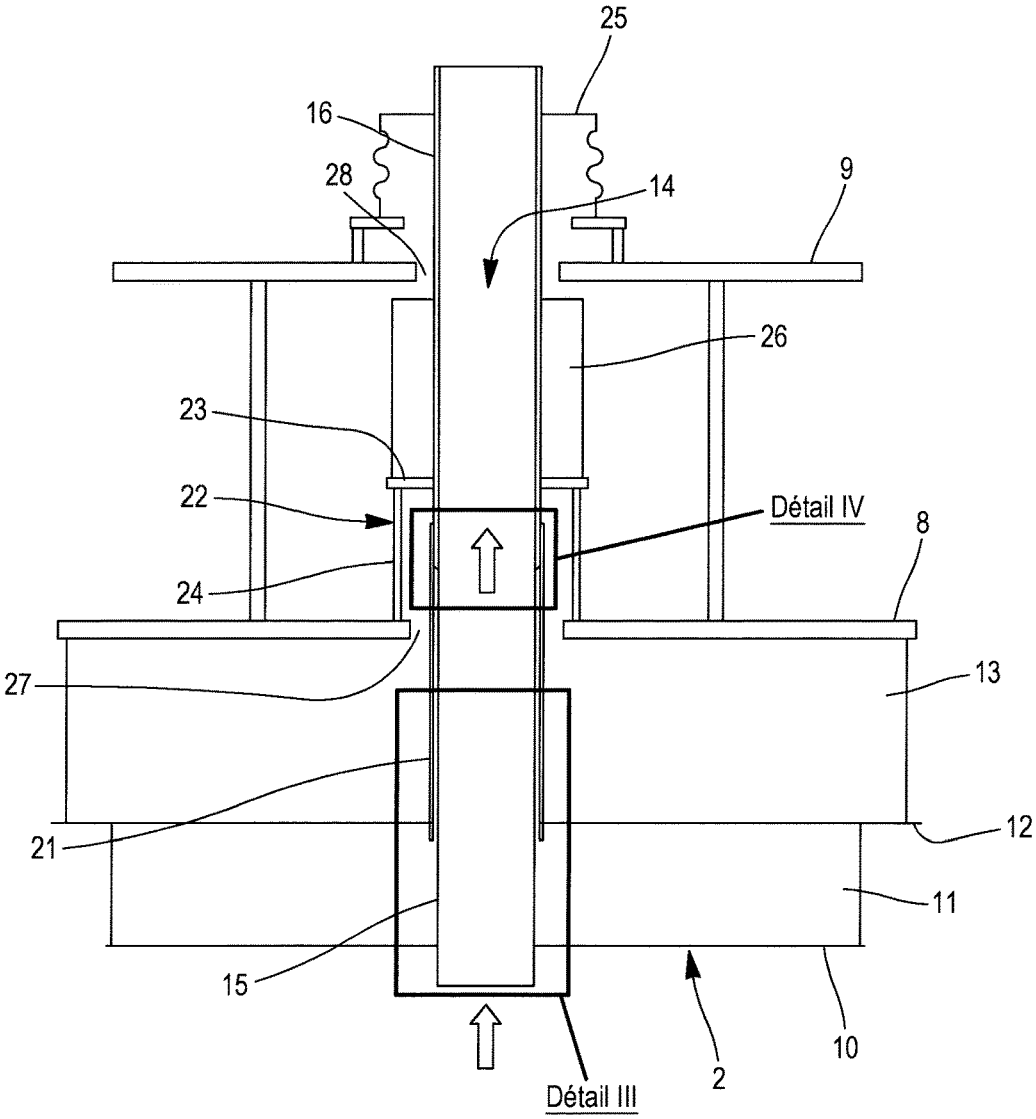
FIG. 2 is a partial schematic representation of an installation for storing and transporting a cryogenic fluid on a ship.

FIG. 2 schematically represents a line 14 making it possible to define an exhaust passage for the vapor phase of the cryogenic fluid from the inside to the outside of the tank 2, the line 14 passing in succession through the tank 2, the intermediate deck 8 of the ship 1 and the top deck 9 of the ship 1.

The sealed and thermally insulating tank 2 has a ceiling wall attached to the intermediate deck 8, the wall comprising, in the thicknesswise direction of the wall from the outside to the inside of the tank 2: a secondary thermally insulating barrier 13, a secondary sealing membrane 12, a primary thermally insulating barrier 11 and a primary sealing membrane 10.

The line 14 is formed by a bottom portion 15 and a top portion 16. The bottom portion 15 is formed from an alloy of iron and of nickel with an expansion coefficient typically lying between $1.2.10^{-6}$ and $2.10^{-6}$ $K^{-1}$, or from an iron alloy with high manganese content with an expansion coefficient typically of the order of $7.10^{-6}$ $K^{-1}$, i.e. a low thermal expansion coefficient. The bottom portion 15 has a first end situated inside the tank 2 and a second end situated outside the tank 2.

The top portion 16 is formed from stainless steel and welded by a first end to the second end of the bottom portion 15 so as to create a continuity of the line 14. The second end of the top portion 16 is linked to a pipeline of the ship 1. The top portion 16 has a greater wall thickness than the bottom portion 15.

The bottom portion 15 of the line 14 passes first of all through the primary sealing membrane 10 and the primary thermally insulating barrier 11. The primary sealing membrane 10 is tightly welded all around the bottom portion 15 to guarantee the continuity of the seal-tightness of the primary sealing membrane 10.

A sheath 21 surrounds the line 14 with a gap in a radial direction and fixed to the top portion 16 of the line 14. The sheath extends from the top portion 16 at least to the secondary sealing membrane 12. The secondary sealing membrane 12 is tightly welded all around the sheath 21 to guarantee the continuity of the seal-tightness of the secondary sealing membrane 12. The line 14 therefore passes through the secondary sealing membrane 12 and the secondary thermally insulating barrier 13 via the sheath 21.

The bottom portion 15 is therefore welded to the top portion 16 inside the sheath 21, so that the sheath 21 guarantees the seal-tightness and the seal-tightness of the secondary membrane in the event of a break of the bottom portion 15, for example at the weld.

The bottom portion 15 therefore serves as a part of the primary sealing membrane 10 whereas the sheath 21 serves as a part of the secondary sealing membrane 12. Thus there are always two membrane layers, even at the line 14.

The line 14 then passes through the intermediate deck 8 of the ship 1 at an intermediate deck orifice 27. The intermediate deck orifice 27 has a diameter greater than the outer diameter of the sheath 21 so that there is a link play allowing the intermediate deck 8 to be deformed without causing deformation of the sheath 21 and of the line 14.

The intermediate deck 8 comprises, on its top surface, a coaming 22. The coaming 22 comprises a top part 23 and a lateral part 24 linking the top part 23 to the intermediate deck 8. The top portion 16 of the line 14 passes through the top part 23 of the coaming 22. The top portion 16 of the line 14 is tightly welded all around the top part 23 of the coaming 22.

The line 14 then passes through the space situated between the intermediate deck 8 and the top deck 9, called betweendeck, where the line is coated with an insulating sleeve 26 so that the low temperatures of the cryogenic gas contained in the line 14 do not cause a high thermal leak in the betweendeck.

The line 14 finally passes through the top deck 9 of the ship 1 at a top deck orifice 28. The top deck orifice 28 has a diameter greater than the outer diameter of the line 14 so that there is a link play allowing the top deck 9 to be deformed without causing deformation of the line 14.

The line 14 comprises a bellows compensator 25 on the second end of the top portion 16 remote from the bottom portion 15. The compensator ensures the fixing of the line 14 to a top surface of the top deck 9 of the ship 1. The bellows compensator 25 has corrugations configured to allow the thermal contraction of the line 14, notably of the top portion 16 which is made of stainless steel, a material which has a high expansion coefficient compared to the alloy of the bottom portion 15.

Figure 3:
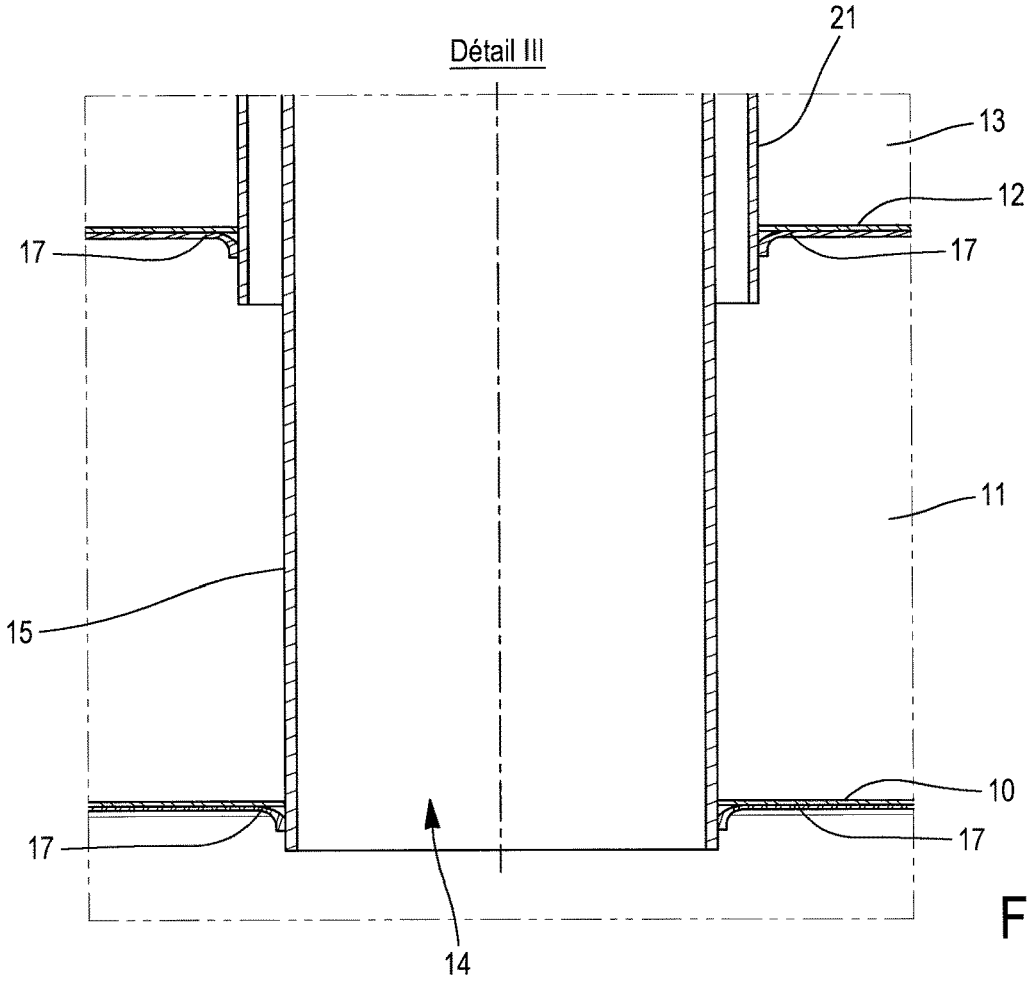
FIG. 3 is an enlarged view of the detail III, of the storage installation of FIG. 2.
Figure 4:
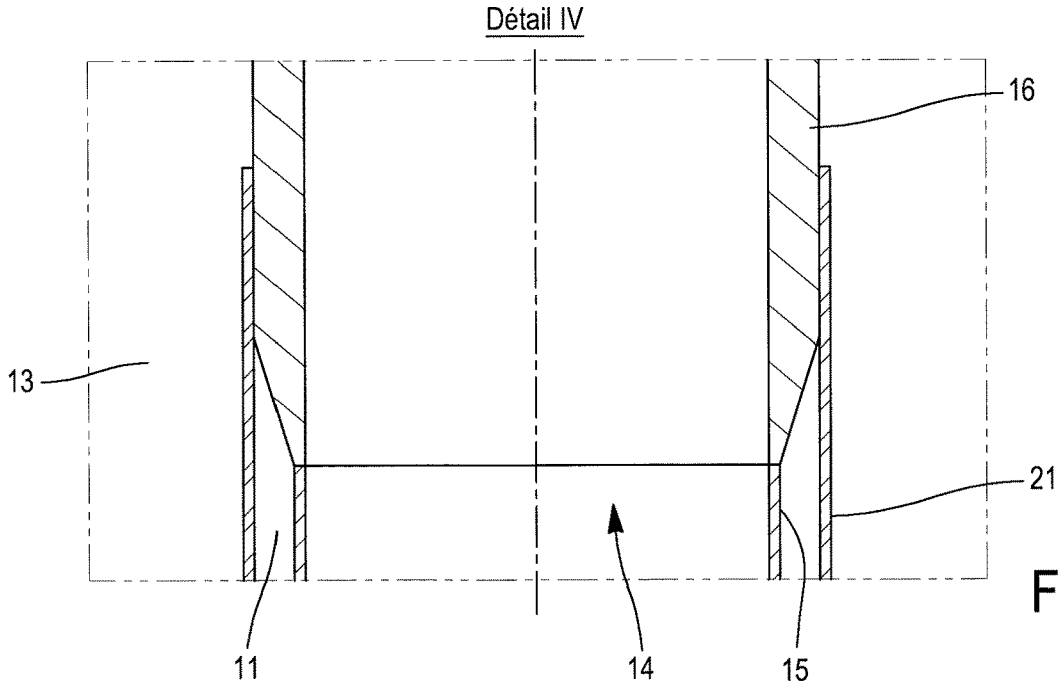
FIG. 4 is an enlarged view of the detail IV, of the storage installation of FIG. 2.

FIGS. 3 and 4 represent enlarged details III and IV of FIG. 2.

FIG. 3 makes it possible to distinguish the fixing of the primary sealing membrane 10 to the line 14 and the fixing of the secondary sealing membrane 12 to the sheath 21. In fact, the fixing of the primary sealing membrane 10 to the line 14 is produced using a flange ring 17 provided with a base and a flange. The flange of the ring 17 is welded to the line 14 and the base of the ring 17 is welded to the primary sealing membrane 10 which makes it possible to produce a tight fixing.

Likewise, the fixing of the secondary sealing membrane 12 to the sheath 21 is produced using a flange ring 17 provided with a base and a flange. The flange of the ring 17 is welded to the sheath 21 and the base of the ring 17 is welded to the secondary sealing membrane 12 which makes it possible to produce a tight fixing.

The base of the flange ring 17 can notably be of flat annular form comprising an inner diameter and an outer diameter. The flange of the flange ring 17 protrudes from the inner diameter of the base of the flange ring 17. The base and the flange of the flange ring have a thickness of 1.5 mm greater than the thicknesses of the primary and secondary sealing membranes 10, 12 of 0.7 mm.

FIG. 4 makes it possible to distinguish the junction between the bottom portion 15 and the top portion 16 of the line 14 and the fixing of the sheath 21 to the top portion 16. In fact, the welded fixing of the second end of the bottom portion 15 and of the first end of the top portion 16 of the line 14 is done with equal thickness of the two portions 15, 16 of the line 14. For that, the thickness of the first end of the top portion 16 decreases, for example linearly, from the thickness of the top portion 16 to the thickness of the bottom portion 15 so as to facilitate the welding of these portions 15, 16 and enhance the strength of the fixing.

The fixing of the sheath 21 to the top portion 16 is done by welding all around the top portion 16 just after the first end of the top portion 16 so that the sheath 21 is fixed to the top portion 16 at a point where its thickness is maximal but also close to the first end of the top portion 16 to minimize the length of the sheath 21 where that is not necessary to act as secondary sealing membrane 12.

Figure 5:
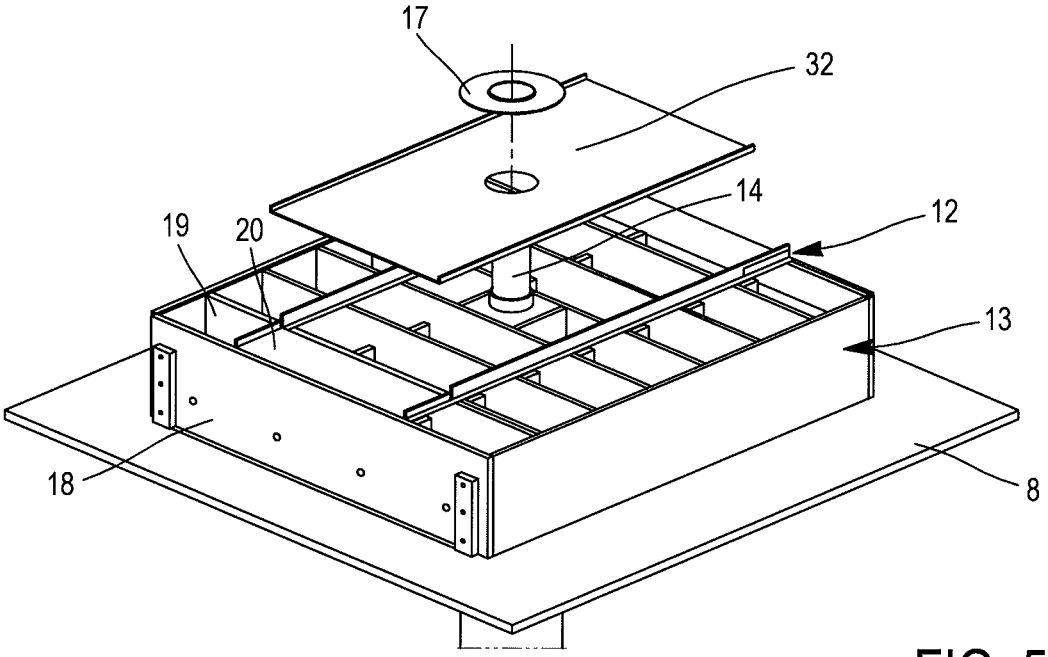
FIG. 5 is an exploded view of a tank wall, notably of the secondary thermally insulating barrier and of the secondary sealing membrane.
Figure 6:
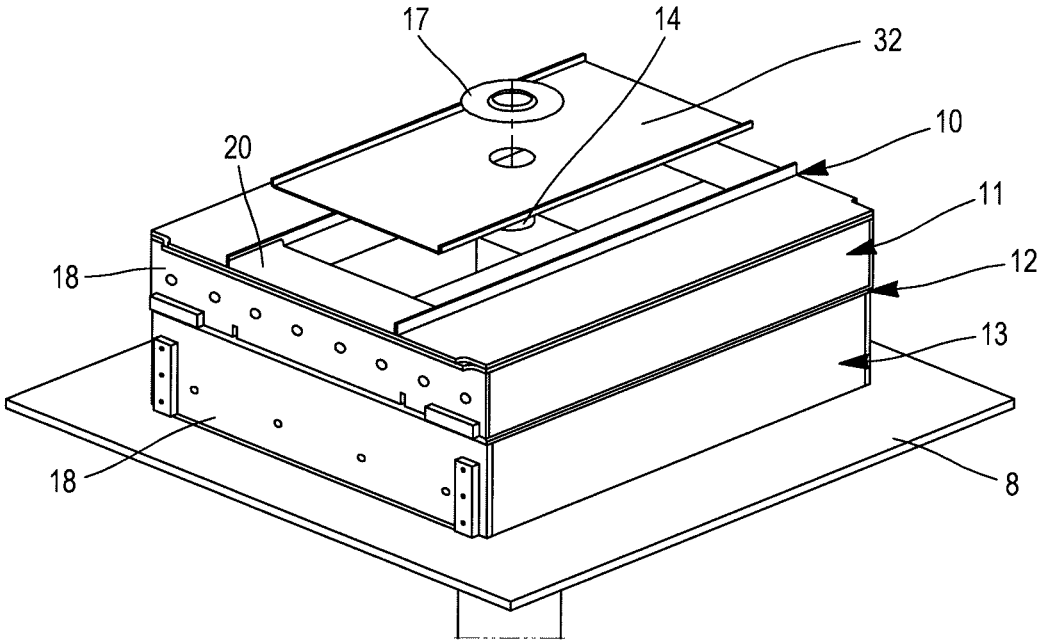
FIG. 6 is an exploded view of a tank wall, notably of the primary thermally insulating barrier and of the primary sealing membrane.

FIGS. 5 and 6 represent schematic views of the primary 10 and secondary 12 sealing membranes and of the primary 11 and secondary 13 thermally insulating barriers. The sealing membranes 10, 12 and the thermally insulating barriers 11, 13 are produced according to the NO96 technology notably described in the document WO2012072906 A1.

Thus, the thermally insulating barriers 11, 13 are, for example, formed by insulating caissons 18 comprising a bottom panel and a cover panel that are parallel, spaced apart along the line of thickness of the insulating caisson 18, bearing elements 19 extending along the line of thickness, optionally peripheral partitions, and a heat insulating lining housed inside insulating caissons. The bottom and cover panels, the peripheral partitions and the bearing elements 19 are for example made of wood, for example plywood, or of a composite thermoplastic material. The heat insulating lining can consist of glass wool, cotton wool or a polymer foam, such as polyurethane foam, polyethylene foam or polyvinyl chloride foam or a granular or powdery material—such as perlite, vermiculite or glass wool—or a nanoporous material of aerogel type. Also, the primary 10 and secondary 12 sealing membranes comprise a continuous sheet of metal strakes 20 with raised edges, said strakes 20 being welded by their raised edges onto parallel weld supports secured to the insulating caissons 18. The metal strakes 20 are, for example, made of Invar®: that is to say an alloy of iron and of nickel with an expansion coefficient typically of between $1.2.10^{-6}$ and $2.10^{-6}$ $K^{-1}$, or an iron alloy with high manganese content with an expansion coefficient typically of the order of $7.10^{-6}$ $K^{-1}$.

FIGS. 5 and 6 make it possible to distinguish where the line 14 passes through the sealing membranes 10, 12 and the thermally insulating barriers 11, 13. In fact, to avoid embrittling the structure of the caisson 18, it is preferable to avoid having the line 14 pass through the caisson on the ends of the caisson 18. Preferably, the line 14 passes through the primary thermally insulating barrier 11 and the secondary thermally insulating barrier 13 in a central zone of the caisson 18 between a plurality of bearing elements 19.

To facilitate the tight fixing of the primary sealing membrane 10 and the line 14 and the tight fixing of the secondary sealing membrane 12 and the sheath 21, it is preferable to avoid having the line 14 pass through the sealing membranes at the raised edges of the strakes 20. In fact, the zone where the edges are raised is geometrically complex and is already subject to the welding linking two adjacent strakes and a support web. That is why the line 14 passes through the sealing membranes 10, 12 in a flat zone of a strake 20 between two raised edges.

The strakes 20 of the primary sealing membrane 10 and of the secondary sealing membrane 12 passed through by the line 14 comprise a reinforced portion 32 so as to retain a continuity of the primary and secondary sealing membranes. In fact, the reinforced portion 32 represents a section of the strake 20 passed through by the line 14.

The reinforced portion 32 has a greater thickness than the rest of the strake 20, for example a thickness of 1.5 mm compared to a strake of 0.7 mm thickness. The reinforced portion 32 comprises a flat zone between two longitudinal raised edges. The line 14 passes through the reinforced portion 32 of the primary sealing membrane 10 and the reinforced portion 32 of the secondary sealing membrane 12 through the flat zone. The sheath 21 passes through the reinforced portion 32 of the secondary sealing membrane 12 also through the flat zone.

Figure 7:
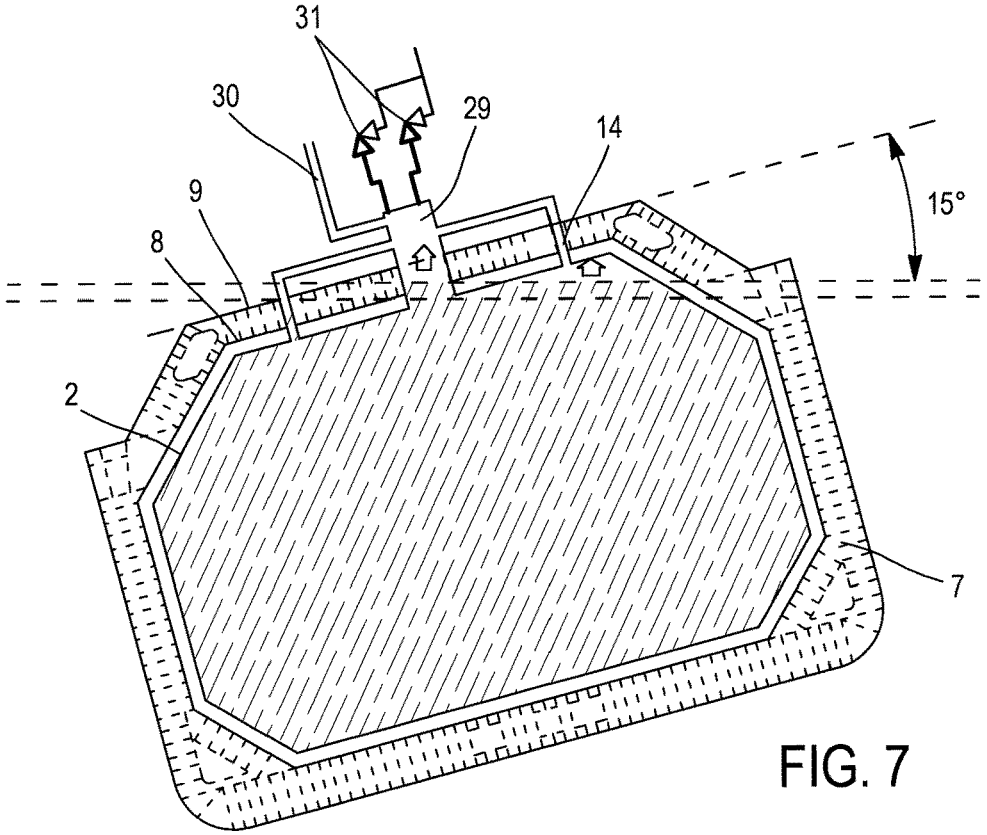
FIG. 7 is a schematic cross-sectional view of an inclined cryogenic fluid storage tank.

FIG. 7 represents a sealed and thermally insulating tank 2 filled with a liquefied gas and transported by a ship 1, the ship having fifteen degrees of list for example because of grounding.

In a normal case of use, with a ship having zero degrees of list, the tank 2 discharges the liquefied gas which is evaporated to avoid generating overpressures inside the tank 2 through a gas dome 29 passing through the ceiling wall of the tank 2 at its center.

In the case of an abovementioned grounding, with a ship having fifteen degrees of list, the gas dome 29 is fully immersed in the liquefied gas and can no longer fulfil its role of discharging the evaporated liquefied gas. To avoid having the overpressure damage the tank 2, two lines 14 situated at the ends of the ceiling wall and on either side of the gas dome 29 are placed in the tank 2 passing through the ceiling wall. The lines 14 are then linked to the main gas collector 30 of the ship 1 which conveys the gas to the engine compartment 3 and/or to a reliquefaction unit. The lines 14 are also linked to pressure relief valves 31 which open if the pressure is too great, thus redirecting a portion of the gas to the exhaust risers 4.

Preferentially, the lines 14 are linked to the main gas collector 30 and to the pressure relief valves 31 via the gas dome 29 outside the double hull 7.

Other details concerning the number and the position of the gas exhaust lines can be found in the publication WO2016120540 A1.

Figure 8:
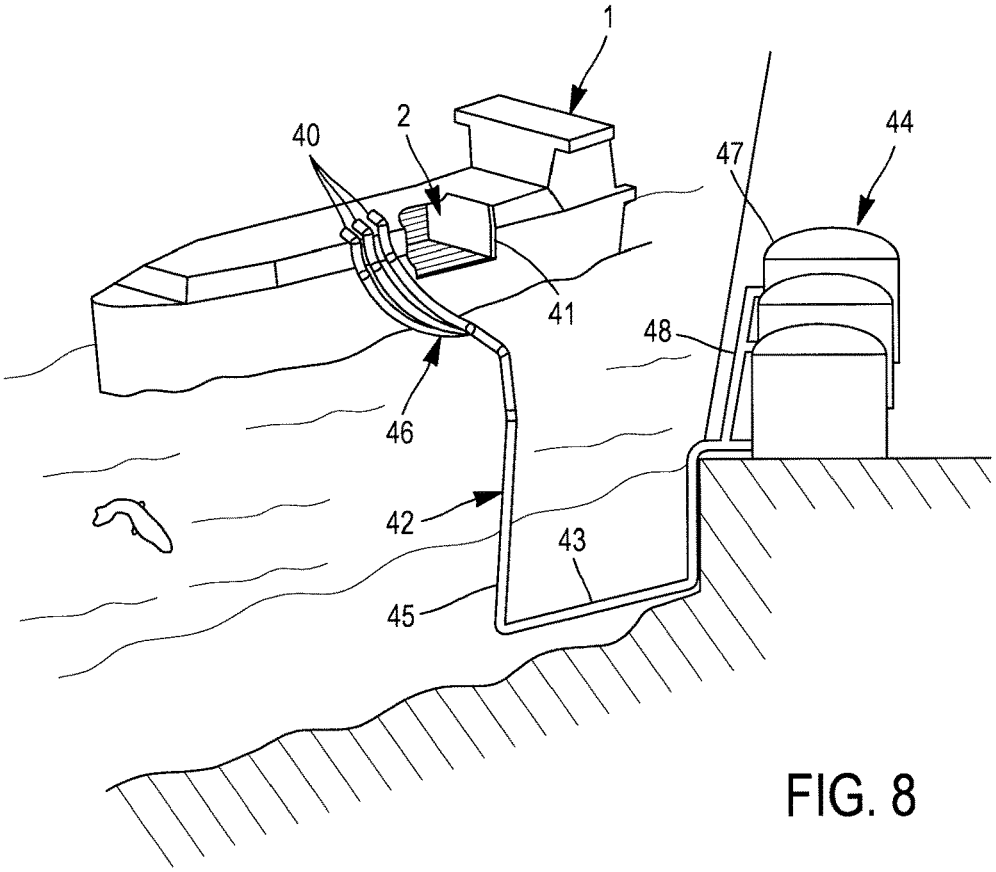
FIG. 8 is a cutaway schematic representation of a ship comprising a cryogenic fluid storage tank and of a terminal for loading/offloading this tank.

Referring to FIG. 8, a cutaway view of a methane tanker ship 1 shows a sealed and insulated tank 2 of generally prismatic form mounted in the double hull 7 of the ship 1.

As is known per se, loading/offloading pipelines 40 disposed on the top deck 9 of the ship 1 can be connected, by means of appropriate connectors, to a maritime or port terminal to transfer a liquefied gas cargo from or to the tank 2.

FIG. 8 represents an example of maritime terminal comprising a loading and offloading station 42, a submarine line 43 and an onshore installation 44. The loading and offloading station 42 is a fixed offshore installation comprising a mobile arm 41 and a riser 45 which supports the mobile arm 41. The mobile arm 41 supports a bundle of insulated flexible pipes 46 that can be connected to the loading/offloading pipelines 40. The orientable mobile arm 41 adapts to all methane tanker templates. A link line that is not represented extends inside the riser 45. The loading and offloading station 42 allows the loading and the offloading of the methane tanker 1 from or to the onshore installation 44. The latter comprises liquefied gas storage tanks 47 and link lines 48 linked by the submarine line 43 to the loading or offloading station 42. The submarine line 43 allows the transfer of the liquefied gas between the loading or offloading station 42 and the onshore installation 44 over a great distance, for example 5 km, which makes it possible to keep the methane tanker ship 1 at a great distance from the coast during the loading and offloading operations.

To create the pressure necessary to the transfer of the liquefied gas, pumps are implemented that are embedded in the ship 1 and/or pumps with which the onshore installation 44 is equipped and/or pumps with which the loading and offloading station 42 is equipped.

Although the invention has been described in association with a number of particular embodiments, it is quite obvious that it is in no way limited thereto and that it comprises all the technical equivalents of the means described and the combinations thereof provided the latter fall within the context of the invention.

The use of the verb "comprise" or "include" and its conjugate forms does not preclude the presence of elements or steps other than those stated in a claim.

In the claims, any reference symbol between parentheses should not be interpreted as a limitation on the claim.

The invention claimed is:

1. An installation for storing and transporting a cryogenic fluid on a ship (1), the installation comprising:

a sealed and thermally insulating tank (2) intended for the storage of the cryogenic fluid in a state of diphasic liquid-vapor equilibrium, the tank (2) having a ceiling wall comprising, in the direction of a thickness of the wall from the outside to the inside of the tank (2), a primary thermally insulating barrier (11) and a primary sealing membrane (10) intended to be in contact with the cryogenic fluid;

a sealed line (14) penetrating through the ceiling wall of the tank (2) so as to define a passage for discharging the vapor phase of the cryogenic fluid from the inside to the outside of the tank (2), the line (14) comprising a bottom portion (15) of which a first end is situated inside the ceiling wall of the tank (2) and a second end is situated outside the ceiling wall of the tank (2) in a thicknesswise direction of the ceiling wall, and a top portion (16) fixed to the second end of the bottom portion (15);

wherein the bottom portion (15), in contact with said cryogenic fluid, is composed of an alloy while the upper portion (16) comprises a stainless steel, said alloy of the bottom portion (15) having a lower thermal expansion coefficient than said stainless steel, and wherein the primary sealing membrane (10) is gas-tightly fixed to the bottom portion (15) of the line (14) around the line (14).

2. The installation as claimed in claim 1, wherein said alloy of the bottom portion (15) of the line (14) is an iron-nickel alloy whose thermal expansion coefficient is between 1.2 and $2.0\times10^{-6}$ $K^{-1}$ and the primary sealing membrane (10) is composed of an iron-nickel alloy whose thermal expansion coefficient is between 1.2 and $2.0\times10^{-6}$ $K^{-1}$.

3. The installation as claimed in claim 1, wherein the bottom portion (15) is gas-tightly welded to the primary sealing membrane (10) via a flange ring (17).

4. The installation as claimed in claim 3, wherein the ceiling wall of the tank (2) also comprises, in the thicknesswise direction of the wall outside the primary thermally insulating barrier (11), a secondary thermally insulating barrier (13) and a secondary sealing membrane (12).

5. The installation as claimed in claim 4, wherein the primary thermally insulating barrier (11) and the secondary thermally insulating barrier (13) are each composed of a plurality of insulating caissons (18), the line (14) passing right through one of the caissons (18) of the plurality of caissons (18) of each of the primary and secondary thermally insulating barriers.

6. The installation as claimed in claim 4, wherein the primary sealing membrane (10) and/or the secondary sealing membrane (12) comprise a plurality of elongate strakes (20) with raised edges welded edge-to-edge in the longitudinal direction of the strake, each strake (20) comprising a flat zone between two longitudinal raised edges, the line (14) passing through the primary sealing member and/or the secondary sealing membrane (12) through the flat zone of an elongate strake (20).

7. The installation as claimed in claim 6, wherein the strake (20) of the primary (10) and/or secondary (12) sealing membrane comprises a reinforced portion (32), the reinforced portion (32) having a greater thickness than the rest of the strake (20) and comprising a flat zone between two longitudinal raised edges, the line (14) passing through the flat zone of the reinforced portion (32).

8. The installation as claimed in claim 4, wherein the installation comprises a sheath (21) surrounding the line (14) with a gap in a radial direction and fixed to the top portion (16) of the line (14), the sheath (21) extending from the top portion (16) at least to the secondary sealing membrane (12), and the secondary sealing membrane (12) being gas-tightly fixed to the sheath (21) all around the sheath (21).

9. The installation as claimed in claim 8, wherein the sheath (21) is welded to the secondary sealing membrane (12) via a flange ring (17).

10. The installation as claimed in claim 6, wherein the flange ring or rings (17) have a thickness greater than the strakes (20).

11. A ship (1) comprising an installation (1) as claimed in claim 1, the ceiling wall being attached to a bottom surface of an intermediate deck (8) of the ship (1).

12. The ship (1) as claimed in claim 11, wherein the line (14) comprises a bellows compensator (25) on an end of the top portion (16) remote from the bottom portion (15), the compensator (25) being configured to ensure the fixing of the line (14) to a top surface of a top deck (9) of the ship (1), the compensator (25) having corrugations configured to allow the thermal contraction of the line (14).

13. The ship (1) as claimed in claim 11, wherein the line (14) comprises an insulating sleeve (26) surrounding a part of the top portion (16) of the line (14) and situated between the intermediate deck (8) of the ship (1) and a top deck (9) of a ship (1).

14. The ship (1) as claimed in claim 13, wherein the intermediate deck (8) and the top deck (9) comprise an orifice (27, 28), the orifice (27, 28) having a diameter greater than an outer diameter of the top portion (16) of the line (14), the line (14) passing through the intermediate deck (8) and the top deck (9) through the intermediate deck orifice (27) and the top deck orifice (28) respectively.

15. The ship (1) as claimed in claim 14, wherein the intermediate deck (8) comprises a coaming (22) on a top surface of the intermediate deck (8), the coaming (22) surrounding the intermediate deck orifice (27) and being passed through by the line (14), and wherein the line (14) is fixed to the coaming (22).

16. A method for loading or offloading a ship (1) as claimed in claim 11, wherein a cryogenic fluid is conveyed through insulated pipelines (40, 43, 46, 48) from or to a floating or onshore storage installation (44) to or from a tank (2) of the ship (1).

17. A transfer system for a cryogenic fluid, the system comprising a ship (1) as claimed in claim 11, insulated pipelines (40, 43, 46, 48) arranged so as to link the tank (2) installed in the double hull (7) of the ship (1) to a floating or onshore storage installation (44) and a pump for driving a flow of cryogenic fluid through the insulated pipelines from or to the floating or onshore storage installation to or from the tank (2) of the ship (1).

18. The installation as claimed in claim 2, wherein the bottom portion (15) is gas-tightly welded to the primary sealing membrane (10) via a flange ring (17).

19. The installation as claimed in claim 1, wherein the ceiling wall of the tank (2) also comprises, in the thicknesswise direction of the wall outside the primary thermally insulating barrier (11), a secondary thermally insulating barrier (13) and a secondary sealing membrane (12).

20. The installation as claimed in claim 2, wherein the ceiling wall of the tank (2) also comprises, in the thicknesswise direction of the wall outside the primary thermally insulating barrier (11), a secondary thermally insulating barrier (13) and a secondary sealing membrane (12).

* * * * *